United States Patent [19]

Boucher et al.

[11] 4,202,662

[45] May 13, 1980

[54] PHOTOGRAPHIC PRINTING PROCESS, AND COMPOSITION AND DEVICE FOR USE THEREIN

[76] Inventors: Robert Boucher, Route du Bois de Nefles, Ile de la Reunion, 97490 Sainte-Clotilde, France; André Foulquier-Gazagnes, Papeete, French Polynesia

[21] Appl. No.: 872,547

[22] Filed: Jan. 26, 1978

Related U.S. Application Data

[63] Continuation of Ser. No. 562,976, Mar. 28, 1976, abandoned.

[30] Foreign Application Priority Data

Aug. 3, 1974 [FR] France ..... 74 11761

[51] Int. Cl.[2] ..... D06P 5/20

[52] U.S. Cl. ..... 8/444; 96/89; 96/90 R; 8/465; 8/651; 430/332

[58] Field of Search ..... 8/2, 35, 34, 70

[56] References Cited

U.S. PATENT DOCUMENTS

| | | | |
|---|---|---|---|
| 2,213,745 | 6/1940 | Schenzel | 8/2 |
| 2,214,365 | 9/1940 | Flynn et al. | 8/2 |
| 2,521,485 | 9/1950 | Schoen | 8/35 |
| 2,559,807 | 7/1951 | Topham | 8/35 |
| 2,580,873 | 1/1952 | Womble | 8/14 |
| 3,944,382 | 3/1976 | Doerr | 8/34 |

FOREIGN PATENT DOCUMENTS

| | | | |
|---|---|---|---|
| 604696 | 7/1948 | United Kingdom . | |
| 633634 | 12/1949 | United Kingdom . | |
| 674642 | 6/1952 | United Kingdom | 8/2 |
| 1259530 | 1/1972 | United Kingdom . | |

OTHER PUBLICATIONS

K. Venkataraman, "The Chemistry of Synthetic Dyes," vol. II (Academic Press, New York), 1952, pp. 1055–1058.

Claussen et al., J. Soc. Dyers and Colourists, 1965, 81, pp. 350–355.

Reynolds, Silk Journal and Rayon World, Jul. 1945, pp. 32 and 42.

*Primary Examiner*—A. Lionel Clingman

*Attorney, Agent, or Firm*—Stevens, Davis, Miller & Mosher

[57] ABSTRACT

The invention provides a photographic printing process which consists of impregnating a support with a photosensitive composition comprising a leuco ester of a vat dyestuff, an acid-generating substance and a catalyst, squeezing out the said support, and exposing the latter to light. The invention also provides equipment for carrying out the process continuously comprising an impregnation tank, a cylindrical irradiation drum equipped with a light source of elongated shape, a neutralization tank, a buffering tank and a rinsing tank. The said drum is equipped to receive, on its outer surface, a photographic plate and a strip of impregnated woven fabric. This process makes it possible to produce monochrome or polychrome patterns with permanent colors.

8 Claims, 1 Drawing Figure

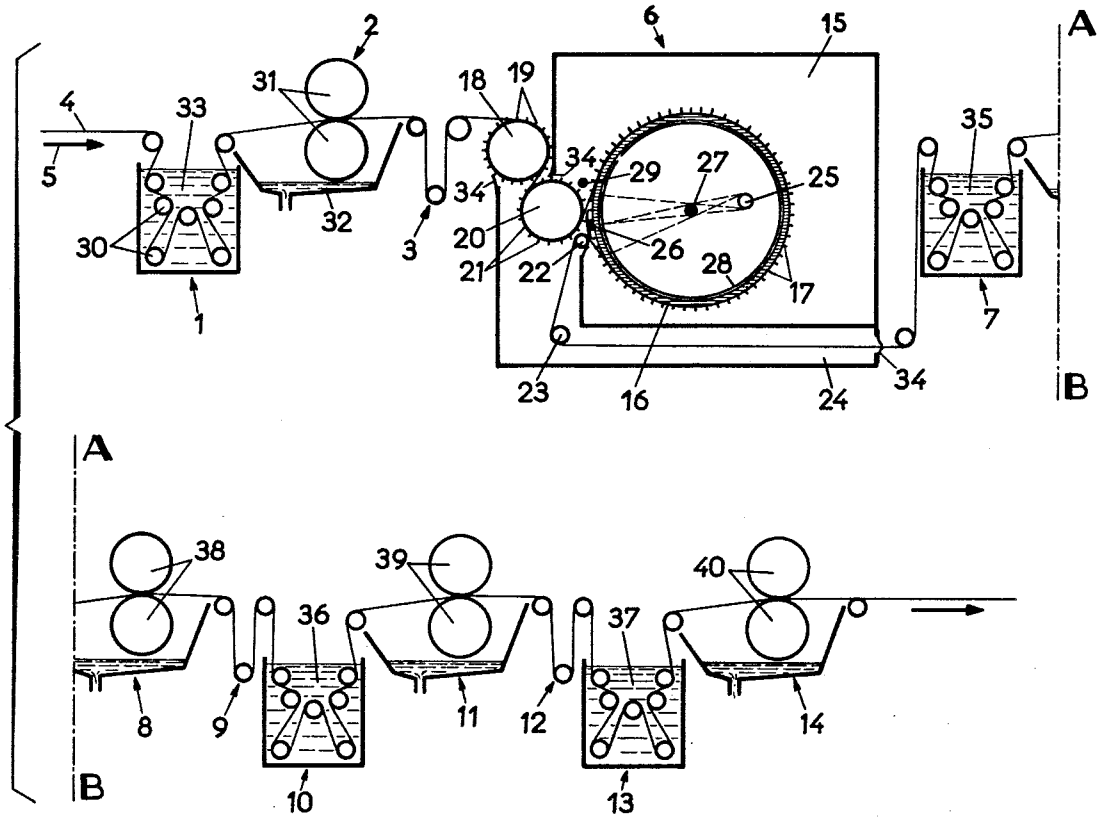
A
B
35
7
34
15
25
17
24
27
28
6
29
26
16
34
22
23
19
18
34
20
21
3
2
32
31
33
1
30
4
5
14
40
37
13
12
11
39
36
10
9
38
8
A
B

PHOTOGRAPHIC PRINTING PROCESS, AND COMPOSITION AND DEVICE FOR USE THEREIN

This is a continuation of application Ser. No. 562,976 filed Mar. 28, 1976, now abandoned.

The present invention relates to photodyeing to produce monochrome or polychrome patterns on a support, e.g. of natural or synthetic fibres.

Processes which make it possible to produce patterns on woven fabric, by means of negative or photographic plates, are usually employed where the design to be reproduced is very fine and where engraving would thus be expensive. The woven fabric is then generally impregnated in a photosensitive bath containing potassium nitrate and ammonium nitrate in aqueous solution. The process is generally carried out discontinuously, first of all drying the impregnated woven fabric at a low temperature in the absence of light and then exposing it to light under a negative plate for a period of time which varies depending on the condition of the plate and the intensity of the light. All the processes known hitherto comprise a step involving drying the impregnated and drained woven fabric before exposure to light.

For photographic printing, it is also known to use a solution of a leuco-ester of a vat dyestuff, to which it is possible to add formic acid and optionally hygroscopic agents, such as glycerine or in particular urea, in order to accelerate the action of the light. This process, however, cannot be applied in the textile industry.

The present invention provides a new process for effecting photochemical dyeing, using a composition which makes it possible to produce patterns on any dyeable support whatever, but preferably a hydrophilic support, by means of a photographic process.

The invention also provides a device which makes it possible, by using specific photosensitive compositions, continuously to produce patterns on woven fabric, by means of a photographic process, without involving a drying step before exposure to light. The value of the present invention resides in the simplicity and the rapidity of the photo-dyeing operations, as well as in the diversity of the supports which can be used and of the applications. A further advantage of the present invention is that it makes it possible to work on sensitised woven fabric which has not been dried before exposure to light.

The process which is the subject of the invention also makes it possible to obtain exact prints and remarkably rich colours. These prints, moreover, possess very good fastness to light, to washing and to repeated sterilising operations.

The process which is the subject of the present invention consists essentially of impregnating a support, and especially a textile support, with a photosensitive composition, of squeezing out the support and of exposing the drained support to actinic light, the support thus treated being optionally washed, rinsed and dried.

The photosensitive composition used in the new process consists of a solution, of strength between 1 and 10%, of a leuco-derivative of a vat dyestuff dissolved in water, to which ammonium sulphate, ammonium vanadate or metavanadate, and optionally ammonium thiocyanate or ammonium dichromate have been added. It is also possible to add to the composition an acid-generating substance such as disodium hydrogen pyrophosphate or ammonium acetate, used in accordance with the dyestuff employed. The amount of ammonium sulphate used is between 0.1 and 4%, of ammonium thiocyanate or ammonium dichromate are between 0.1 and 1%, and of ammonium vanadate or metavanadate between 0.01 and 0.02%, the percentages being expressed by weight.

The acid-generating substance can be introduced at a maximum concentration of approximately 5 g. per liter. The use of the said acid-generating substances is explained by the fact that these products have a "buffering" reaction, that is to say that, during use, when exposed to actinic light, the stabilising alkaline agent namely, $NH_4$ in the case of ammonium acetate, is removed and regenerates the free acid.

The dyestuffs used are leuco-esters of vat dyestuffs, and in particular of anthraquinone dyestuffs.

It is possible to increase the sensitivity of the emulsion by adding acetic acid, in an amount of 0.5 g/l in the case of natural fibres and in amounts which can be as much as 5 g./l in the case of synthetic fibres.

It is also possible to mix different dyestuffs in one and the same emulsion, in order to obtain composite colours or a range of varied shades.

The supports which can be used in the present invention can be flexible or rigid and of animal, vegetable, mineral or synthetic origin. Supports which are or have been rendered hydrophilic and which have not been treated chemically are, however, preferably used.

The emulsion described above can be applied either manually or in a device which makes it possible to work continuously. To achieve this, it suffices to impregnate the support uniformly, wholly or partially, and to expose it to an actinic light source such as sunlight, arc lamps or xenon lamps. The exposure time can vary between a few seconds and several minutes, depending on the intensity of the light source and the dyestuffs employed.

A uniform and permanent colour is obtained in this way.

It is possible, for example, to decorate the support by interposing between the latter and the light source opaque masks, the outline of which will be obtained as a negative. In this case, it is necessary to remove the excess composition from the support, by steeping, washing or boiling in a detergent solution, the said operation being followed by rinsing. An arresting bath containing sodium hydroxide (approximately 2 g. per liter) makes it possible to delay the above operation.

The process described above gives a monochrome print. For a polychrome print, the operation can be repeated several times using different masks and different colours. It is also possible to use in the emulsion a mixture of dyestuffs which are developed successively, such as, for example, a mixture of brown, orange and turquoise, giving first of all orange, brown and finally green.

A particularly valuable example of printing employing a mask could be the use of a translucent or transparent material, dyed or shaded with an opaque product, and optionally a photographic negative, in order to obtain a decoration as a positive. It is also possible to use colour-photographic trichromatic negatives, and this limits the production of all the composite fundamental colours to three successive operations.

These operations can be carried out either by direct exposure to the light source, or by means of a glazed plateholder, or using a mechanical device which permits continuous printing on any flexible and moist support, optionally facilitating, by means of exact registering on the support, the use of three-coloured photographic negatives.

Such a device consists, for example, of: an impregnation tank, followed by a squeezing mangle possessing a lug or any other means for guiding the support, and by a compensating roller;

an irradiation box which is impervious to light and which contains a drum made of a transparent material mounted so as to rotate freely about its axis and intended to receive the support on its outer face (possessing the same guiding and drive device as that provided on the squeezing mangles) and optionally photographic negatives on its outer face; and inside this drum, where a means of ventilation is provided, an elongated light source which is off centre relative to the axis of the drum and is opposite the point where the support enters and leaves the irradiation box, and which is equipped in addition with a reflector which can be adjusted so as to delimit the irradiation of the support, depending on the period of time desired;

a neutralisation tank followed by a squeezing mangle possessing the same device for guiding the support as above, and by a compensating roller;

a buffering tank followed by a squeezing mangle and a compensating roller; and a rinsing tank followed by a squeezing mangle identical to the above and a compensating roller; and a device for drying the support.

It is to be noted that the photosensitive composition of the present invention can be prepared and presented with a view to using the same, in the form of a composition containing the various compounds used or preferably in the form of a 2-compartment package containing the dyestuff on one side and, on the other, the solution containing the catalyst, the acid-generating substance and the other salts in the defined proportions, with a view to using the composition under specific conditions of illumination and exposure times, for photodyeing.

The following Examples illustrate the invention.

EXAMPLE 1

Decoration of a handkerchief.

A handkerchief, the edge of which has already been rolled, which is made of batiste formed from white or raw yarn and which contains neither size nor starch and an orange composition prepared in the following way are used.

30 g. of Anthrasol Orange HR supplied by Messrs. Hoechst are dissolved in 600 g. of boiling water. 40 g. of a solution of ammonium sulphate prepared by dissolving one part by weight of ammonium sulphate in two parts of tepid water, 20 g. of a solution of ammonium vanadate prepared by dissolving one part of sodium vanadate in 100 parts of tepid water; and 10 g. of a solution of ammonium thiocyanate prepared by dissolving 1 part of ammonium thiocyanate in 2 parts by weight of tepid water are added to the solution of dyestuff. The said mixture is made up to 1,000 g. with cold water.

The decoration desired for the handkerchief is drawn, with an opaque ink such as Indian ink or an opaque gouache, on a photosensitive paper (for example a "Kodatrace" type paper) and a negative of this decoration is taken, by contact. The actual printing is carried out using a plateholder consisting of a glazed lid and a rigid base covered with flexible padding which makes it possible to press any article to be decorated by photography and the photographic negative between padding and glass.

The handkerchief is completely impregnated with the composition on the cushion of the plate-holder, the negative and the glass of the lid covering the handkerchief.

After exposure to sunlight and as soon as the orange colour appears, the handkerchief is immersed in an arresting bath containing sodium hydroxide where it can be kept for a period of time which can be as long as 24 hours.

Still working in semi-darkness, and after rapid rinsing, the handkerchief or handkerchiefs are boiled with a suitable lye such as the following:

| | |
|---|---|
| sodium tripolyphosphate (Termphos supplied by Messrs. Hoechst) | 36% |
| sodium perborate | 22% |
| sodium carbonate (supplied by Messrs Solvay) | 5% |
| carboxymethylcellulose (Tylose CR 1500 supplied by Messrs. Hoechst) | 4% |
| optical bluing agent (Blankophor HZPA 766 supplied by Messrs. Bayer) | 0.2% |
| surface-active agent (Arcopal N100 or Genapol T110 supplied by Messrs. Hoechst) | 4% |
| linear secondary alkanosulphonate (Hostapur SAS 65 supplied by Messrs. Hoechst) | 12% |
| anhydrous sodium sulphate | 16.8% |

The handkerchiefs are boiled for 30 minutes, rinsed, then boiled again in clear water for 30 minutes, followed by another rapid rinsing, drying and ironing. Handkerchiefs which are indelibly decorated, even after many sterilising operations, are thus obtained.

EXAMPLE 2

Following a procedure identical to that of Example 1, it is possible to produce a yellow decoration on a woven fabric made of cotton. The following composition is used for this purpose:

| | |
|---|---|
| Anthrasol Yellow V supplied by Messrs. Hoechst | 60 g. |
| boiling water | 600 g. |
| solution of ammonium sulphate | 70 g. |
| solution of ammonium vanadate | 20 g. |
| solution of ammonium thiocyanate | 10 g. |
| cold water, q.s.p. | 1,000 g. |

The solutions of ammonium sulphate, ammonium vanadate and ammonium thiocyanate are the same as those described in Example 1. The impregnated woven fabric is exposed, as in the preceding Example, to light and is then boiled, rinsed, dried and ironed as above. A yellow decoration which possesses noteworthy fastness to washing, to rubbing and to light is thus obtained.

EXAMPLE 3

Decoration of a scarf made of natural silk.

It is desired to place large sepia initials at the end of a scarf made of natural silk and of size 0.30/1.20 m. The stencil is cut out of an opaque material, and the composition is prepared in the following way under diffuse lighting:

| | |
|---|---|
| Anthrasol Brown IRRD supplied by Messrs. Hoechst | 10 g. |
| boiling water | 120 g. |
| solution of ammonium sulphate | 8 g. |
| solution of ammonium vanadate | 4 g. |
| solution of ammonium thiocyanate | 2 g. |

-continued

| | |
|---|---|
| cold water, q.s.p. | 200 g. |

The solutions of ammonium sulphate, ammonium vanadate and ammonium thiocyanate are the same as in Example 1.

The scarf is completely impregnated with the composition and then thoroughly squeezed out. It is spread, folded in two so as to form a rectangle of 0.30 × 0.60 m, on the cushion of the plate-holder used in Example 1. The lower part of the scarf which does not have to be printed is insulated from the upper part to be decorated, with an opaque sheet.

The stencil is placed at the desired spot, surrounded by an opaque plastic material, so that the light can touch only the pattern to be printed. The glass of the plate-holder is pressed over the whole, and the combination is subjected to sunlight for a few minutes. As soon as the sepia colour can be seen very clearly through the glass the plate-holder is again placed in a room with diffuse lighting where it is opened, and the scarf is immersed in a bath at 60° C. to which lye has been added.

The following lye is used for this purpose:

| | |
|---|---|
| sodium perborate | 20% |
| sodium hexametaphosphate | 38% |
| optical bluing agent (Blankophor HZPA 766 supplied by Messrs. Bayer) | 0.2% |
| Arcopal N100 (supplied by Messrs. Hoechst) | 6% |
| Hostapur SAS 65 (supplied by Messrs. Hoechst) | 12% |
| anhydrous sodium sulphate | 23.8% |

The scarf thus obtained is agitated for 30 minutes in this bath so as to remove the excess composition, is then rinsed at the same temperature, and is finally agitated again for 30 minutes in a bath of clear water at 60° C. The scarf is finally dried and ironed.

A scarf made of wool may be treated in an identical manner.

EXAMPLE 4

Printing of a set of table mats made of cotton cloth in "two colours".

A "black and white" negative representing a landscape or the reproduction of an ancient lithograph is, for example, used. The cotton cloth is impregnated with a composition comprising:

| | |
|---|---|
| Anthrasol 04G (turquoise) (supplied by Messrs. Hoechst) | 30 g. |
| Anthrasol Brown IRRD (supplied by Messrs. Hoechst) | 20 g. |
| Anthrasol Orange HR (supplied by Messrs. Hoechst) | 10 g. |
| boiling water | 600 g. |
| solution of ammonium sulphate | 40 g. |
| solution of ammonium vanadate | 20 g. |
| solution of ammonium thiocyanate | 10 g. |
| cold water, q.s.p. | 1,000 g. |

The solutions of ammonium sulphate, ammonium vanadate and ammonium thiocyanate are as in Example 1. 0.5 g. of acetic acid is added to the said solution, in order to increase the sensitivity of the composition. The same procedure as above is used, but, for the step involving exposure to light, the negative is placed in the middle of the woven fabric impregnated with the emulsion and is protected from direct contact with the emulsion by a transparent plastic material placed on the impregnated woven fabric.

The development of the photographic print is watched through the lightest parts of the negative and especially around the negative.

The orange colour develops and appears within a few seconds, then changes to orange-brown which becomes increasingly dark and suddenly changes to green around the photographic negative, the whole process taking approximately 10 minutes.

By stopping the exposure to light when the first green sheen appears around the negative, a very warm sepia shade is obtained with an orange sheen in the distance which gives depth to the photographic landscape.

It is also possible to wait until the green has "come out" well around the negative; a landscape is thus obtained, the close-up areas of which are dark green with brown patches and the distant areas of which are lighter or darker orange-brown. As above, the printing is ended by means of an arresting bath and two successive boiling operations, the first using the same lye as in Example 1 and the second using water.

EXAMPLE 5

Preparation of a set of table mats made of raffia.

Prior to any operation, the raffia is rendered hydrophilic by boiling for one hour in a bath containing 2 g. per liter of Hostapur SAS 65 (supplied by Messrs. Hoechst) and 3 g. per liter of sodium carbonate (supplied by Messrs Solvay). After the raffia has cooled in its bath, it is rinsed copiously with water and dried. Thereafter, the photosensitive composition is deposited uniformly on the raffia. For this purpose, a composition which makes it possible to obtain a green colour and which is prepared in the following way is, for example used:

| | |
|---|---|
| Anthrasol 04B (royal blue) supplied by Messrs. Hoechst | 20 g. |
| Anthrasol Yellow V supplied by Messrs. Hoechst | 40 g. |
| boiling water | 600 g. |
| solution of ammonium sulphate | 60 g. |
| solution of ammonium vanadate | 20 g. |
| solution of ammonium thiocyanate | 10 g. |
| cold water, q.s.p. | 1,000 g. |

The solutions of ammonium sulphate, ammonium vanadate and ammonium thiocyanate are prepared in a manner identical to that of Example 1.

The set of raffia table mats is spread on the cushion of the plate-holder. A "black and white" negative is placed on the raffia support and is insulated from the emulsion by a sheet of plastic material, and the glass of the plate-holder is pressed over the whole. The combination is subjected to sunlight for a few minutes. As soon as the green colour can be seen very clearly through the glass, the plate-holder is opened under diffuse light, and the set of table mats is immersed in a bath at 60° C. to which there has been added a lye possessing the following composition: sodium tripolyphosphate

| | |
|---|---|
| (Termphos supplied by Messrs. Hoechst) | 10 g/l |
| sodium carbonate (supplied by Messrs. Solvay) | 5 g/l |
| Tylose CR 1500 (supplied by Messrs. Hoechst) | 0.5 g/l |
| Arcopal N100 (supplied by Messrs. Hoechst) | 2 g/l |

The raffia support is rinsed and is boiled again in clear water for 30 minutes, followed by rapid rinsing and drying.

EXAMPLE 6

Continuous formation of a decoration on a strip of woven fabric made of natural or synthetic fibres.

The woven fabric is treated in the photographic printing device illustrated in the accompanying drawing, in which the figure is a diagrammatic cross-sectional view in elevation showing the path of the woven fabric through the equipment used.

It is seen from the figure that the equipment comprises an impregnation tank 1, followed by a squeezing mangle 2 and a compensating roller 3. At the outlet of the compensating roller 3, the woven fabric 4, which moves forwards in the direction of the arrow 5, enters the actual irradiation device 6. The woven fabric then passes successively through: a neutralisation tank containing sodium hydroxide 7, followed by a squeezing mangle 8 and a compensating roller 9; and a buffering tank 10, followed by a squeezing mangle 11 and a compensating roller 12. The woven fabric finally enters a rank 13 for effecting rinsing with water, this tank being also followed by a squeezing mangle 14, before issuing from the equipment to be either cut up or introduced into another apparatus, thus producing a second colour.

The irradiation device 6 consists of a box 15 which is impervious to light and inside which there is mounted, so that it can rotate freely, a cylindrical drum 16 which is made of a transparent material such as glass or plexiglass and which possesses two rows of drive lugs 17 on its outer surface. A guide roller 18, which is mounted so as to rotate freely about an axis parallel to that of the drum 16, and which, like the latter, possesses drive lugs 19 on its periphery, is positioned at the inlet of the irradiation box 15. After the woven fabric 4 has passed over the guide roller 18 it is taken up by a pressure roller 20 rotating freely about an axis parallel to that of the drum 16 and also possessing two rows of drive lugs 21 on its periphery. It is seen in the figure that the roller 20 brings the woven fabric 4 into contact with the outer surface of the irradiation drum 16. A release roller 22 keeps the woven fabric in contact with practically all the outer surface of the irradiation drum 16 and conveys the exposed woven fabric, by means of an idling roller 23, inside a leakproof chamber, as far as the outlet of the irradiation device 6.

A light source of elongated shape 25 can be formed, for example, by a xenon tube of power 5,000 watts. A protective screen 26 which is opaque to light is placed outside the irradiation drum 16 and is positioned in such a way that the light source 25 and the screen 26 are situated on either side of the axle 27 of the irradiation drum 16, the axle 27 being preferably opaque and having a relatively large diameter.

A negative photographic plate 28 is fixed by any suitable means to the outer surface of the irradiation drum 16. The plate 28 can, for example, be simply stuck by means of an adhesive tape to the outer surface of the drum 16. The said plate, protected by a lacquer, is brought into close contact with the woven fabric.

A safety bar 29 is spaced outside the drum 16, in the vicinity of the point where the woven fabric comes into contact with the outer surface of the irradiation drum 16, so as to prevent the woven fabric 4 from remaining fixed to the pressure roller 20, thus causing the device to stop and the woven fabric to be damaged. This equipment operates in the following way:

The woven fabric 4 is first of all made to pass through the impregnation tank 1, which comprises a certain number of immersion rollers 30 which make it possible to lengthen the path of the woven fabric 4 inside the tank 1. The latter possesses, in a known manner, a device for automatically controlling the level of the bath, for example by means of floats. It is possible for constant renewal of the bath, by means of a pump, which is not represented in the figure, and an emptying device.

The photosensitive compositions used are, for example, the emulsions used in the preceding Examples. The following emulsion may, for example, be used:

| | |
|---|---|
| Anthrasol Orange HR (supplied by Messrs. Hoechst) | 40 g/l |
| acid-generating substance such as ammonium acetate | 5 g/l |
| ammonium dichromate | 4 g/l |
| ammonium sulphate | 2 g/l |
| 1/1,000 solution of ammonium vanadate $NH_4VO_3$ | 2 g/l |

the concentration of the solution being chosen so that the ambient light cannot fog the woven fabric.

The squeezing mangle 2 consists of two rubber rollers which can, for example, possess a Shore hardness of 40°. In this way, squeezing out to the extent of 100% is achieved, and the excess photosensitive solution which is in the trough 32 is reintroduced into the impregnation tank. The rollers 31 of the squeezing mangle 2 are actuated by a suitable motor, not represented in the figure, which drives the woven fabric 4 in the direction of the arrow 5. The compensating roller 3, placed at the outlet of the squeezing mangle 2, makes it possible to compensate for variations in the drive speed of the rollers 31 and to prevent too high tensile forces on the woven fabric.

At the outlet of the compensating roller 3, the woven fabric is wound around the guide roller 18 and then passes over the pressure roller 20 before being pressed against the outer surface of the irradiation drum 16. The latter, driven by the woven fabric, rotates about its axis with a continuous movement and this has the effect of exposing the woven fabric 4 impregnated with the photosensitive solution 33 in accordance with the pattern represented as a negative on the plate 28.

Under the effect of the high light intensity from the source 25, it is possible to vary the exposure time by adjusting the rate of travel of the woven fabric 4. It is to be noted that, owing to the prticular arrangement of the light source 25 and the opaque screen 26, the woven fabric 4 is not exposed to light when it is not suitably pressed against the outer face of the irradiation drum 16.

After passing over the release roller 22, the exposed woven fabric 4 enters the chamber 24 which is impervious to light. It is thus seen that, inside the irradiation device 6, the woven fabric 4 follows a winding path which, in combination with the lip gaskets 34 placed everywhere where there is a danger that light might escape, makes it possible to prevent the woven fabric from being exposed to the light from the source 25 when it is not suitably pressed against the irradiation drum 16 and thus opposite the negative plate 28.

It should be noted that the irradiation box 15 is advantageously equipped with a ventilation device which makes it possible to cool the irradiation drum 16 and to compensate for the rise in temperature due to the presence of the light source 25. The side and upper walls of the irradiation box 15 are moreover preferably equipped with portions which permit ready access to the irradiation drum 16 as well as to the rollers 18 and 20. In this way, it is possible easily to introduce and replace the negative plate 28 and it is also easy to carry out the registering and adjustment processes which are necessary at the start of operations.

The tanks 7, 10 and 13 as well as the squeezing mangles 8, 11 and 14, are practically identical to the impregnation tank 1 and the squeezing mangle 2 described above. The tank 7 contains a solution of sodium hydroxide 35, the tank 10 contains a buffer solution 36 and the rinsing tank contains water 37. Like the rollers 31 of the squeezing mangle 2, the rollers 38, 39 and 40 of the squeezing mangles 8, 11 and 14 are driven by suitable motors which are not represented in the figure and the variations in the speed of which are compensated for by the compensating rollers 9 and 12.

In order to produce polychrome patterns, it is sufficient to change the nature of the various baths and to provide for passage over three consecutive irradiation drums. It is also possible to produce such polychrome patterns by using a single irradiation drum and by effecting three successive passes through different impregnation baths.

The present invention can be used for photographic printing or photodyeing of all kinds of woven fabrics and makes it possible to obtain a true dyeing which withstands washing and even washing with soap. The woven fabrics thus treated can be used for various purposes.

Of course, various changes, improvements or additions can be introduced into the embodiments which have just been described and certain equivalent components can be replaced without thereby changing the general economics of the invention. In particular, dyestuffs other than those mentioned in the Examples can be used, such as:

Anthrasol Scarlet IB,

Anthrasol Grey IB2,

Anthrasol Violet ARR and

Anthrasol Pink IR extra, supplied by Messrs. Hoechst, as well as other leuco-esters of vat dyestuffs supplied by different manufacturers and with different trademarks. It is also possible to use different concentrations, the latter varying in inverse proportion to the light intensity used.

It is also possible to use exposure devices which are different from those described, such as slide projectors.

We claim:

1. A method of photodyeing a natural or synthetic fiber which comprises:

(a) impregnating a dyeable support of said natural or synthetic fiber with an aqueous photosensitive composition comprising a leuco ester of a vat dyestuff, an acid-generating substance and a catalyst selected from the group consisting of ammonium vanadate or meta vanadate; and (b) exposing to actinic light the moist inpregnated dyeable support.

2. A method of photodyeing a natural or synthetic fiber which comprises:

(a) impregnating a dyeable support of said natural or synthetic fiber with an aqueous photosensitive composition comprising 1 to 10% by weight of a leuco ester of a vat dyestuff, 0.1 to 2% by weight ammonium sulfate, and 0.01 to 1% ammonium thiocyanate or ammonium dichromate and 0.01 to 0.02% by weight ammonium vanadate; and (b) exposing to actinic light the moist impregnated dyeable support.

3. Process according to claim 1, in which the acid-generating substance is ammonium sulphate.

4. Process according to claim 1, in which the photosensitive composition also contains ammonium thiocyanate or ammonium dichromate.

5. Process according to claim 1, in which the composition contains 5 g/l of acetic acid and the support comprises synthetic fibres.

6. Process according to claim 1, in which the composition contains 0.5 g/l of acetic acid and the support comprises natural fibres.

7. Process according to claim 1, in which the vat dyestuff is an anthraquinone dyestuff.

8. Process according to claim 1, in which after the exposure, the support is rinsed, washed and dried.

* * * * *